US005094195A

United States Patent [19]

Gonzalez

[11] Patent Number: 5,094,195

[45] Date of Patent: Mar. 10, 1992

[54] AXIAL CYLINDER INTERNAL COMBUSTION ENGINE

[75] Inventor: Cesar Gonzalez, Wichita, Kans.

[73] Assignee: The Cessna Aircraft Company, Wichita, Kans.

[21] Appl. No.: 512,120

[22] Filed: Apr. 20, 1990

[51] Int. Cl.[5] ..... F02B 75/26

[52] U.S. Cl. ..... 123/58 BA; 123/197.3

[58] Field of Search ..... 123/58 A, 58 B, 58 BB, 123/58 BC, 58 BC, 197 AB, 197 AC

[56] References Cited

U.S. PATENT DOCUMENTS

| | | | |
|---|---|---|---|
| 1,476,275 | 12/1923 | Wishon | 123/58 BC |
| 3,333,577 | 8/1967 | Mongitore | 123/58 B |
| 3,939,809 | 2/1976 | Rohs | 123/197 AB |
| 4,203,396 | 5/1980 | Berger | 123/58 BB |
| 4,207,779 | 6/1980 | Papst | 123/58 B |
| 4,454,779 | 6/1984 | Vos | 123/58 B |
| 4,497,284 | 2/1985 | Schramm | 123/58 B |
| 4,523,549 | 6/1985 | Lacy | 123/58 BC |

FOREIGN PATENT DOCUMENTS

| | | | |
|---|---|---|---|
| 0754174 | 7/1953 | Fed. Rep. of Germany | 123/58 B |
| 1271986 | 11/1986 | U.S.S.R. | 123/197 AC |

*Primary Examiner*—Wills R. Wolfe
*Assistant Examiner*—Thomas N. Moulis
*Attorney, Agent, or Firm*—Edward L. Brown, Jr.

[57] ABSTRACT

A barrel type internal combustion engine having a plurality of axially-positioned cylinders, with reciprocating pistons, arranged in a circular pattern with a drive shaft supported in a cylinder block in a cantilevered manner by a sleeve bearing and a wobble spider rotatably supported on an offset portion of the drive shaft by a second sleeve bearing. A first roller bearing positioned between the offset portion of the drive shaft and the wobble spider, and another roller bearing at the opposite end of the drive shaft acting in opposition to the first roller between the shaft and the engine block supporting thrust loads.

11 Claims, 4 Drawing Sheets

AXIAL CYLINDER INTERNAL COMBUSTION ENGINE

BACKGROUND OF THE INVENTION

The present invention relates to reciprocating piston internal combustion engines and more particularly to a barrel type or axial piston engine wherein the cylinders are arranged around a central drive shaft with their axis parallel thereto. Extensive patents on barrel engines have been granted for well over a century, as illustrated in the patent to Coney U.S. Pat. No. 16,229. Despite their early beginnings, barrel engines have not had any significant commercial successes in either the stationary or transportation fields. In aviation, barrel engines have had appeal because they were compact and required less frontal area and thus less drag on an aircraft with radial engines of comparative cylinder displacement. The most inefficient type of aircraft engine from a frontal area standpoint would be the radial engine when compared with the various in-line designs.

Early in this century a variety of prototype barrel engines were constructed and tested including the Almen engine in 1920, the Swiss Statax engine in 1913; the British Redrup axial engine in 1929, the U.S. Alfaro engine in the 1930's, and a German double-barreled engine (2 T 7/4-II) in the 1940's, all of which were intended for aircraft use. Barrel engines are compact because their pistons reciprocated parallel to the crankshaft rather than perpendicular. A variety of mechanisms and cylinder patterns have been explored such as opposing pistons sharing a common cylinder, as taught in Royal (U.S. Pat. No. 1,808,380) or opposing pistons sharing a common wobble plate or cam system, such as Palmer (U.S. Pat. No. 4,493,188).

In barrel engines the conversion of reciprocating piston motion to rotary driveshaft motion has been accomplished by a variety of designs such as swash plate and slipper arrangements, as shown in the patent to Mitchell (U.S. Pat. No. Re. 15,756); cylindrical cam and roller followers, as shown in the E. S. Hall SAE paper dated Mar. 14, 1940, entitled More Power from a Smaller Engine, FIG. 11, and wobble plates driven by offset shafts as shown in Almen (U.S. Pat. No. 1,255,973). The wobbler mechanisms are in turn connected to the pistons either directly or through connecting rods having pivotal joints at both ends thereof with numerous examples set forth in the above-mentioned SAE Paper by Hall in FIGS. 12 through 33. In spite of the reduced envelope advantages offered by barrel engines, none of the above-mentioned barrel engines ever achieved commercial success over the conventional radial or in-line engines which are driven by conventional crankshafts as known today. The only area wherein axial piston devices have achieved commercial success has been in the field of hydraulic pumps and motors which is a substantially different environment and area of technology from internal combustion piston engines. The nature of the loads, temperatures, pressure gradients, vibratory inputs from combustion and elasticity of the mechanism are all different.

In the patent to Cook et al (U.S. Pat. No. 3,018,737), a hydraulic pump is shown wherein the offset portion of the driveshaft drives the wobble plate and is mounted in a cantilevered fashion to the stationary cylinder block of the pump.

The patents to Akao (U.S. Pat. No. 4,872,431) and Clementz (U.S. Pat. No. 1,480,506) illustrate overhead cam and valve geometries somewhat similar to applicant's designs.

SUMMARY OF THE PRESENT INVENTION

The present invention is a high specific output barrel engine driven by a wobble spider type drive wherein the driveshaft includes an offset portion which rotatably supports the wobble spider through two spaced-apart sleeve bearings that sustain bending loads induced by combustion and inertia contributions, and a roller bearing for carrying thrust loads. The driveshaft of the engine transmits bending loads to the cylinder block through a pair of spaced-apart sleeve bearings while a second roller bearing positioned on the opposite end of the drive shaft carries thrust loadings to the block. Because of the cantilevered design of the bearings supporting the driveshaft, the wobble spider end of the engine requires no radial support thereby permitting the engine or power module to accept a variety of gearbox arrangements or directly driven propellers. Traditionally engine designs support the wobble mechanism on both sides thereof, as shown in FIG. 2, rather than the cantilevered design of the present invention.

The bearing design of the present invention provides a unique configuration wherein the main shaft is supported in the engine block by a pair of spaced-apart sleeve bearings which sustain all of the radial and bending loads derived from combustion and inertia contributions. The axial thrust loads are transmitted from the wobble spider to the offset section of the driveshaft through a roller bearing having a radially-free floating race thus precluding any radial loads from passing through the roller bearing. A similar roller bearing with a free-floating race transmits the thrust loads from the driveshaft to the engine block at the opposite end of the driveshaft.

The connecting rods between the wobble spider and pistons include three distinct elements; the first of which is a half-spherical insert intended to transmit the combustion thrust loads; the second a split half-spherical insert on the opposite side of the ball intended to sustain inertia tension loads imparted by the reciprocating components; with the third element being an intermediate ring spacer of precise height that controls the spherical bearing clearances when the three elements are forced together by a retaining means. These three elements are retained within the piston and wobble spider bearing sockets by a flanged retainer nut.

The unique valve system of the present invention utilizes conventional poppet valves driven by a pair of overhead cams which are positioned in a non-parallel pattern whereby some of the valves are direct-driven by the cam while others not in line with the cam shafts are driven through rocker arms.

A principal object of the present invention is to provide a high power output barrel engine with a reduced number of cylinders and other power train components to provide a simplified and versatile design.

Another object of the present invention is to provide a power module wherein the drive shaft and wobble spider assembly are carried by the cylinder block in a cantilevered manner so that the engine is capable of adaptation to a variety of propeller or gearbox arrangements.

A further object of the present invention is the combined use of sliding sleeve bearings and roller bearings wherein all of the radial and bending loads are carried by the sleeve bearings while the isolated roller bearings carry strictly thrust loadings.

DESCRIPTION OF THE PREFERRED EMBODIMENT

Figure 3:
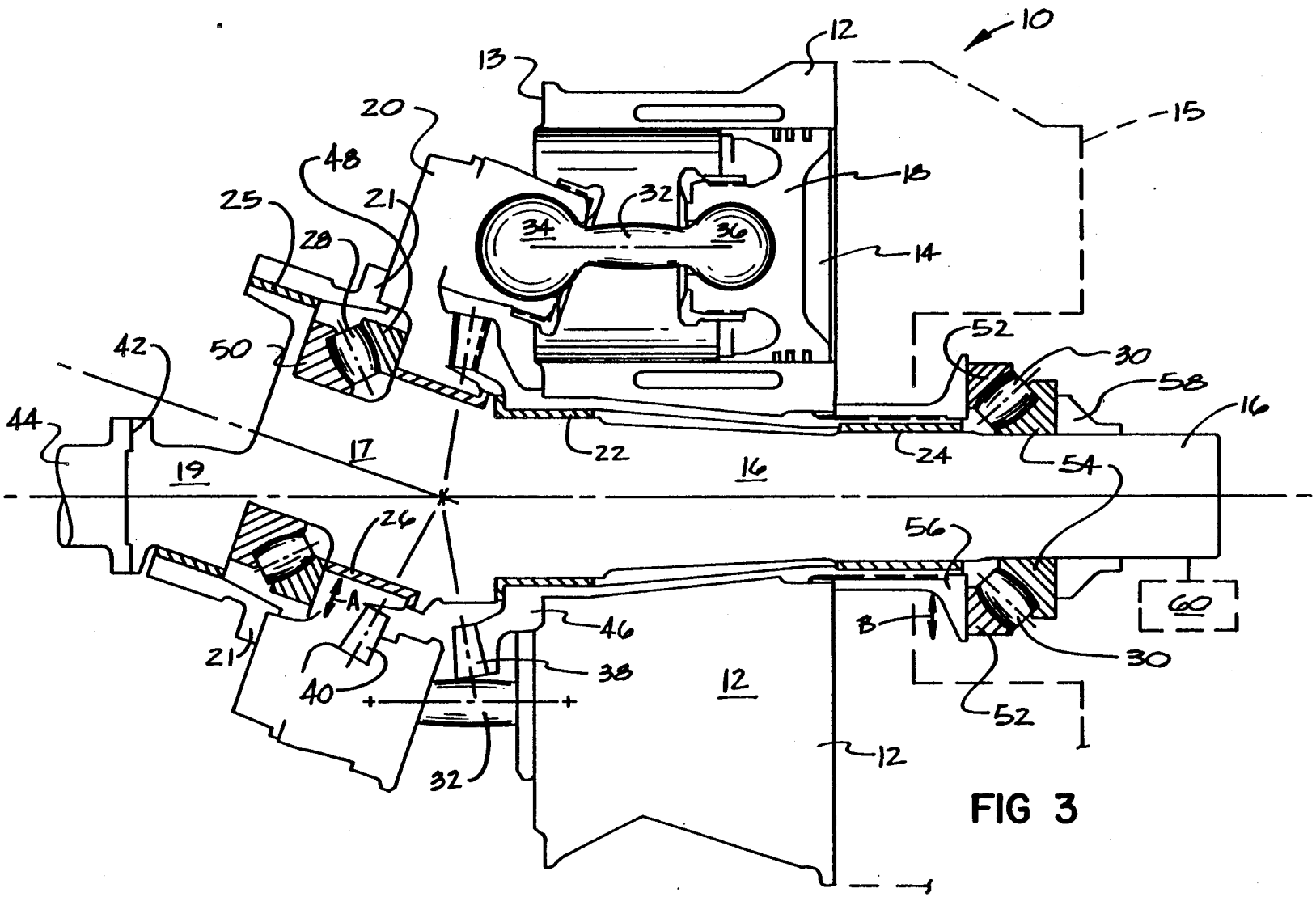
FIG. 3 is a side elevation in longitudinal section illustrating some portions of the engine in symbolic form.

The internal combustion engine of the present invention is best seen in FIG. 3 and is generally described by reference numeral 10. The engine 10 is a barrel type four-cycle internal combustion engine designed for high specific power output which can be utilized with a wide range of power plant configurations. While only two cylinders are seen in FIG. 3, the engine will have an odd number of cylinders from 3 to 9. The cylinder layout and the cam and valve geometry is shown in FIGS. 6, 7 and 8 with the preferred design being the five cylinder arrangement as shown in FIG. 6.

Figure 6:
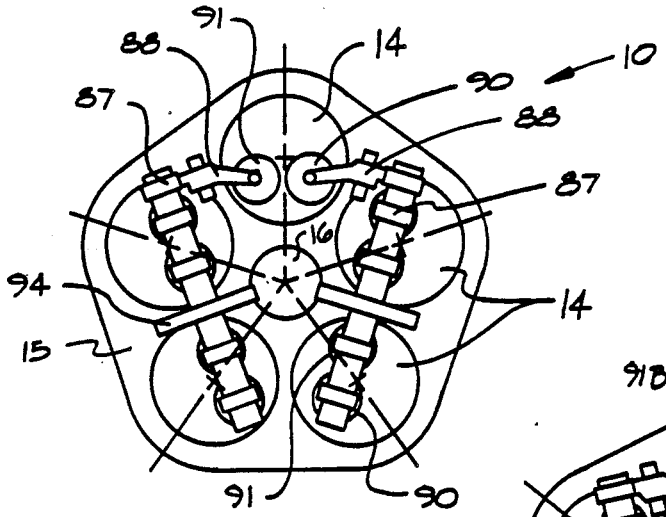
FIG. 6 is an end view of a five cylinder engine with the valve and cam shaft layouts shown in partially schematic form.
Figure 7:
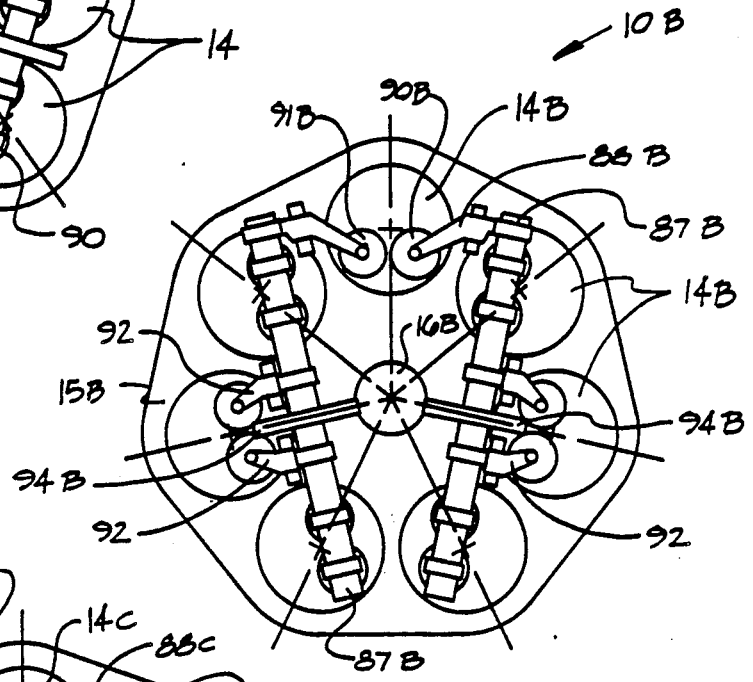
FIG. 7 is a similar end view as FIG. 6 for a seven cylinder engine.
Figure 8:
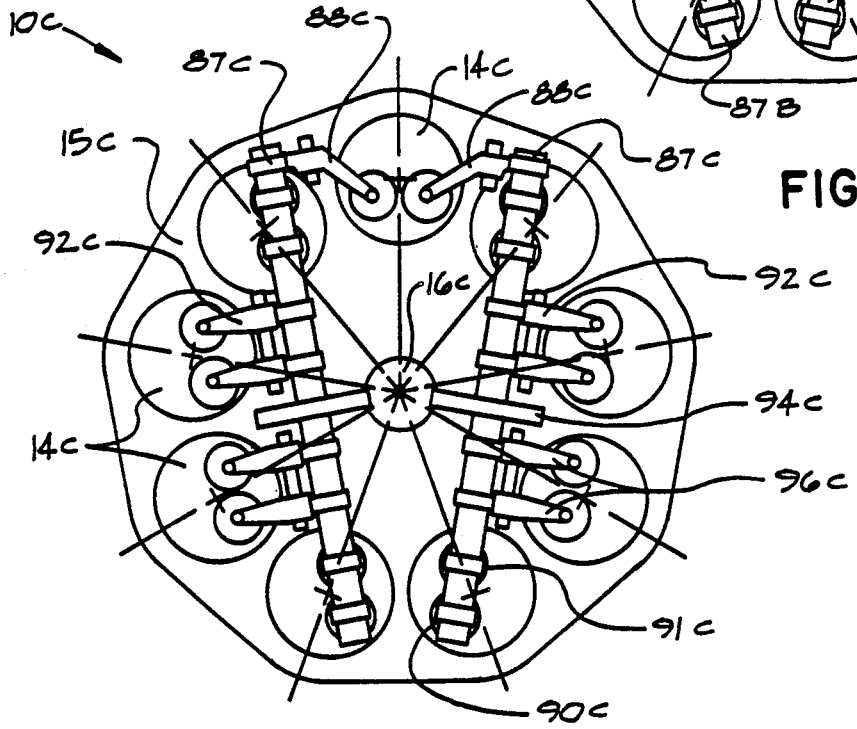
FIG. 8 is a similar end view of a nine cylinder engine.

Barrel engine 10 includes a block 12 having a driveshaft 16 passing through the center thereof and an odd number of cylinders 14 spaced around the block 12 in radial patterns as shown in FIGS. 6, 7 and 8. Positioned in cylinders 14 are pistons 18 which are connected by connecting rods 32 to a wobble spider 20. Driveshaft 16 is rotatably journaled in a pair of sleeve bearings 22 and 24 which are in turn carried by engine block 12. Driveshaft 16, on its left end includes an offset portion 17 which carries two additional sliding sleeve bearings 25 and 26. Wobble spider 20 is in turn rotatably journaled on bearings 25 and 26. Longitudinally positioned between sleeve bearings 25 and 26 is a spherical roller bearing 28 with the inner race 50 firmly retained on offset portion 17, while the outer non-rotating race 48 is free to slide radially, in a direction indicated by arrow A, so that no bending or radial loads may be carried by roller bearing 28. Positioned on the right end of drive shaft 16, immediately adjacent sleeve bearing 24, is a second spherical roller bearing 30 having a stationary inner race 54 anchored to shaft 16 through collar 58. The outer race 52 is free-floating in a direction as indicated by arrow B on the bearing surface of transfer sleeve 56 which in turn attaches to block 12. The heads for each cylinder are conventional and symbolically illustrated by numeral 15 and are not shown in detail with the exception of the cam and valve layouts of FIGS. 6, 7 and 8.

Wobble spider 20 includes a ring gear 40 which mates with an opposing similar gear 38 carried by block 12 through a support sleeve 46. As spider 20 wobbles, there will always be a contact point between gears 38 and 40 thus preventing wobble spider 20 from rotating along with the offset portion 17 of the driveshaft. Extending outwardly from offset portion 17 is the primary drive end 19 of driveshaft 16. Connected to end 19 is the primary driven member 44. This could be a directly-mounted propeller in the application of an aircraft engine or a gearbox which in turn supplies some torque-comsuming function. Positioned between end 19 and primary drive member 44 can be a quill type coupling, which transfers torsional loads only.

Figures 4, 5, 9:
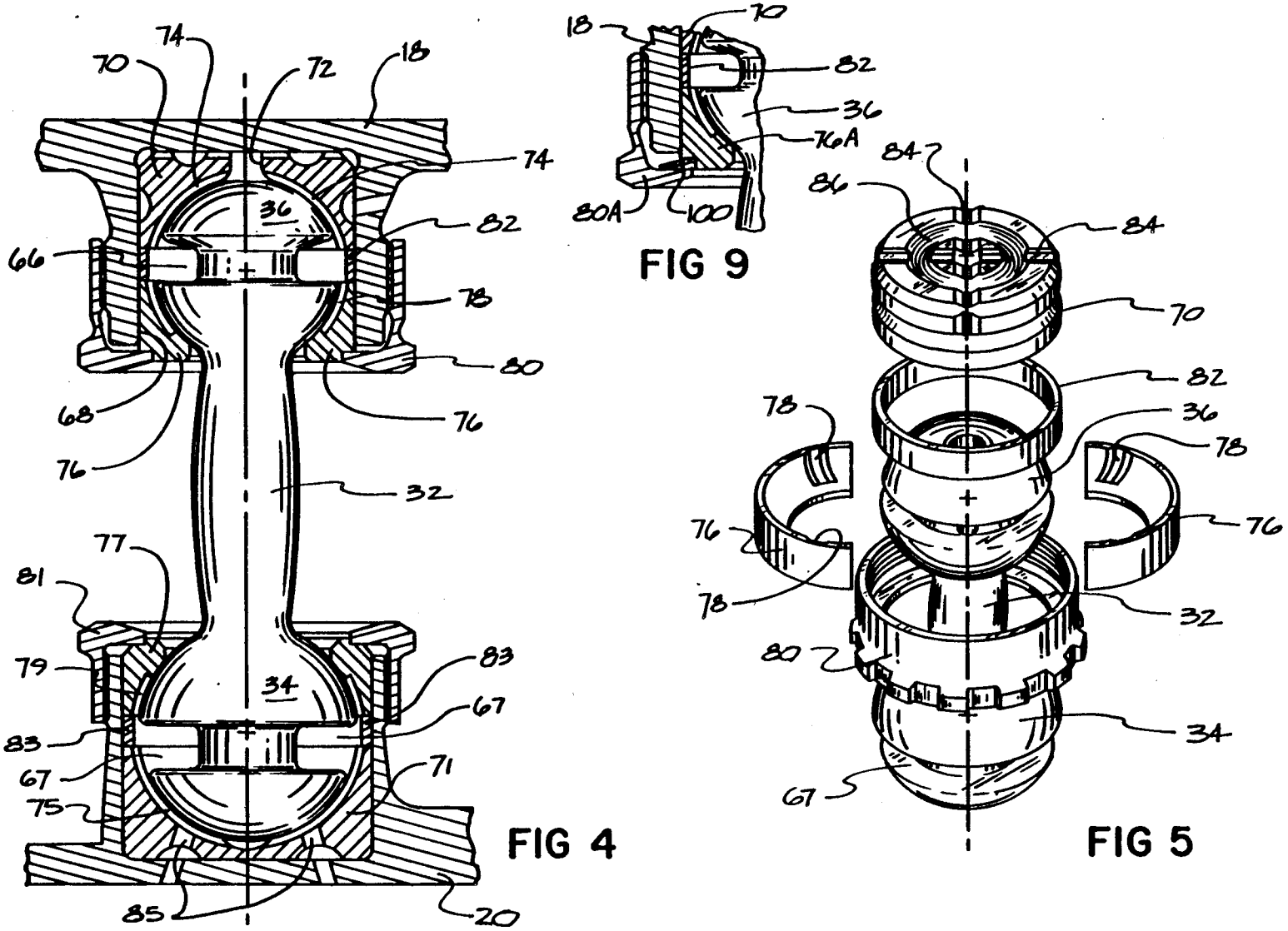
FIG. 4 is a partial cross sectional view of a connecting rod and its spherical bearings within the piston and wobble spider bearing sockets.
FIG. 5 is a perspective exploded view of the spherical bearing parts on the connecting rod.
FIG. 9 is a modification form of the spherical bearing shown in FIG. 4.

Connecting wobble spider 20 to each piston 18 is a connecting rod 32 with spherical rod bearings 34 and 36 on each end thereof. FIGS. 4 and 5 illustrate the various detailed parts of the spherical bearing. Positioned in a pocket in piston 18 is a bearing insert 70 having a half-spherical surface with lubrication grooves 74 spaced apart from center oil passage 72. Insert 70, as seen in FIG. 5, also includes a series of radial grooves 84 and a circular groove 86, both of which transmit lubrication oil to passage 72. In place of bearing insert 70, the semi-spherical bearing surface can be machined directly in the bearing pocket of the piston 18 or wobble spider 20. The bearing inserts 76, which contact the rod end of ball 36, are split for assembly requirements and are properly spaced from bearing insert 70 by a spacer ring 82. Oil grooves 78 on the inside surface of bearing insert 76, as seen in FIG. 5, provide lubrication to the bottom areas of ball 36. Cut around the circumference of balls 34 and 36 are deep annular grooves 67 and 66, respectively, which further facilitate the passage of lubrication oil to grooves 74 and 78. By varying the height of ring 82, the clearance fit of the spherical bearing can be changed.

FIG. 9 illustrates a modified bearing configuration wherein a belville washer 100 is inserted between the inner flange of retaining nut 80A and split insert 76A. The deflected washer 100 being conical in shape provides a preloading on insert 76A whereby if the expansion rate of the bearing parts change, the washer 100 will maintain adequate preloads. Once retaining nuts 80A and 80 are threaded into place, they can be locked by various locking means commonly known in the prior art.

Ball 34 is dimensioned slightly larger than ball 36 and its bearing elements 71, 83 and 77 function in an identical manner as those just described connecting to piston 18. Wobble spider 20 includes oil passages 85 which supply lubrication to oil grooves 75 spaced apart and joined together at the bottom of insert 71. Groove 75 allows oil to pass upward into annular groove 67 and on upward into grooves 79.

Figure 1:
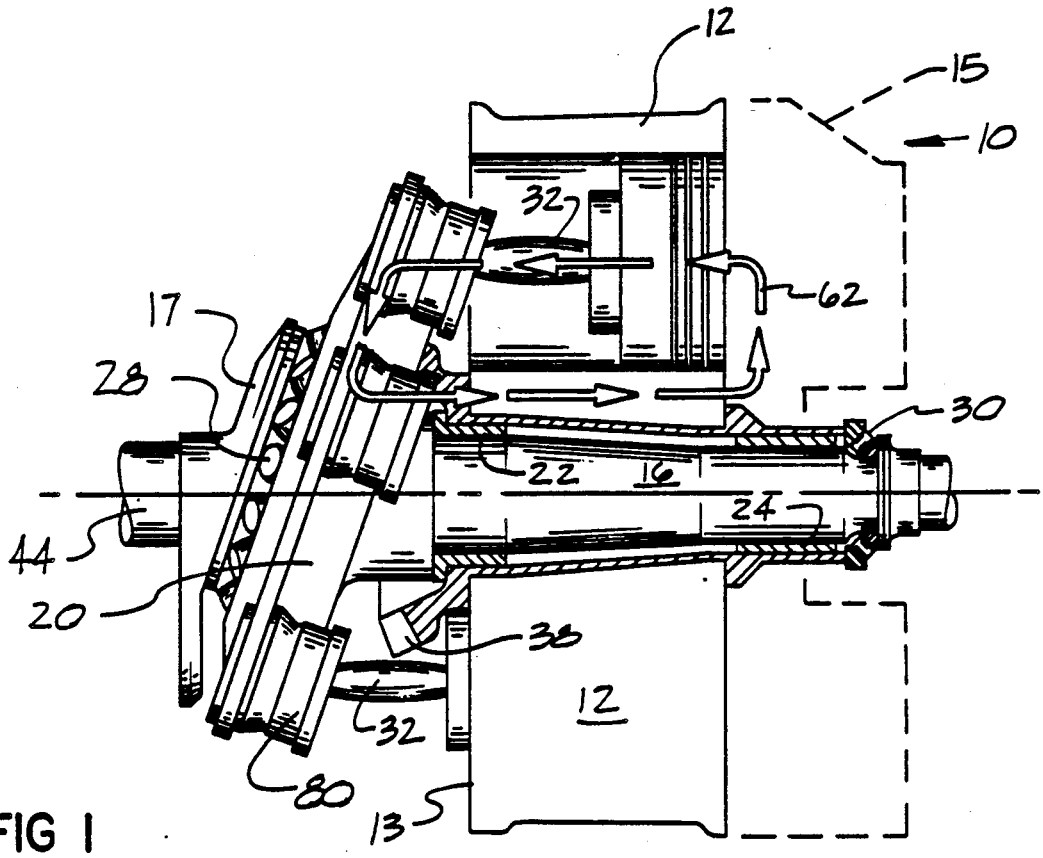
FIG. 1 is a side elevational view of the engine of the present invention, partially in section and partially shown in symbolic form with arrows indicating the path of combustion loads through the engine.
Figure 2:
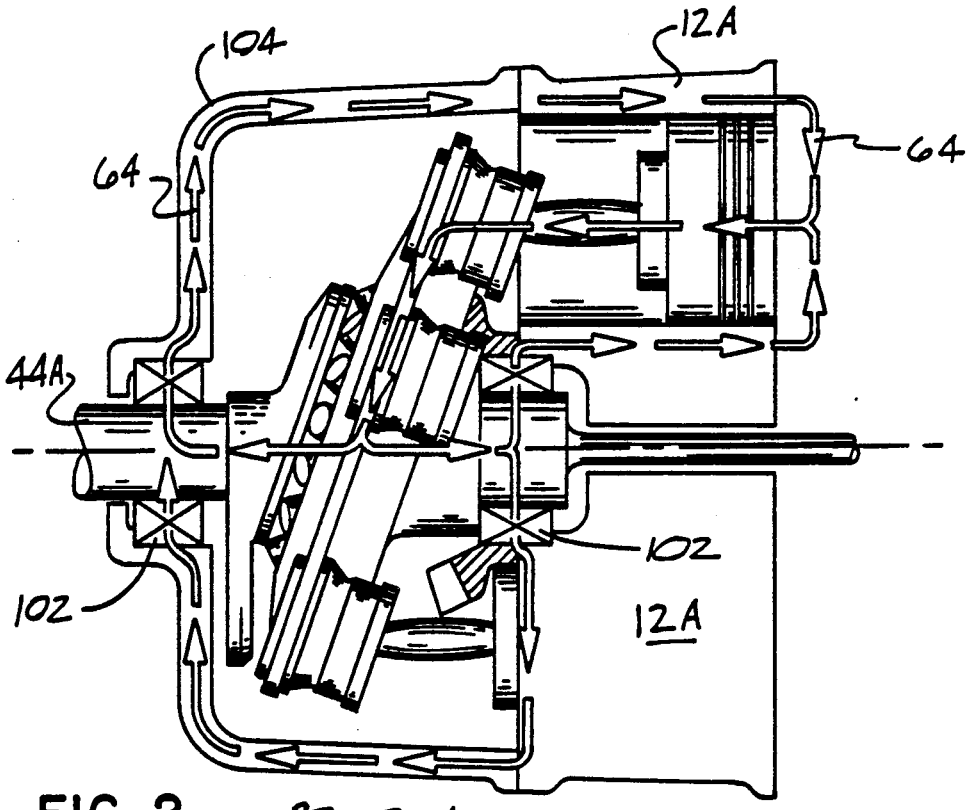
FIG 2 PRIOR ART
FIG. 2 is a similar side elevation view of the prior art.

In FIG. 2, a typical prior art wobble system drive barrel engine is illustrated wherein the offset portion are straddled by a pair of bearings 102 whereby a portion of the load is transmitted through the engine housing 104 back to the block 12A as indicated by arrows 64. With the design of the present invention, the driveshaft 16 is sized sufficiently to act in a cantilevered manner with the combustion and inertia forces acting back through the driveshaft 16 alone, as indicated by arrow 62 through sleeve bearings 22 and 24. With the load carried solely by the driveshaft, the outer engine housing 104 is not necessary. This allows the engine 10 to be adaptable to a variety of differing arrangements or multiple power modules driving through a single output shaft. The front face 13 of the engine block 12 can be readily adapted to a wide variety of mounting configurations.

FIGS. 6, 7 and 8 illustrate the engine in a five, seven and nine cylinder configuration respectively. The five cylinder engine in FIG. 6 utilizes two cams 87 which are driven off of drive shaft 16 through a conventional helical gear set 94. The inlet and exhaust valves 90 and 91 of a pair of adjacent cylinders 14 are all aligned with the cam shaft axis allowing a single overhead cam 87 to directly actuate the respective valves of those two cylinders. While the second cam 87 directly drives the valves on the opposite pair of cylinders 14, the fifth upper most cylinder as seen in FIG. 6 must have rocker arms 88 to actuate its valves since they are offset from the axis of both cams 87. Rocker arms 88 are conventional in design as are the directly acting inlet and exhaust valves of the other four cylinders.

FIG. 7 is a engine configuration including seven cylinders whose inlet and exhaust valves are also actuated by a pair of overhead cams 87B. Each cam shaft 87B is aligned directly over the inlet and exhaust valves of two cylinders while two rocker arms 92, positioned in the center of the cam, operate the inlet and exhaust valves of an intermediate cylinder 14B. Positioned on the upper ends of both cam shafts 87B is a single rocker arm 88B which operates the upper most cylinder 14B in FIG. 7. Both cams 87B are also driven by drive shaft 16B through conventional helical gears 94B which in turn are directly mounted on their respective cam shafts 87B.

FIG. 8 illustrates a nine cylinder configuration of the engine of the present invention with two overhead cams 87C, each actuating the inlet and exhaust valves of four cylinders along with a single valve of the upper most center cylinder 14C. Each cam 87C is axially aligned over inlet and exhaust valves 90C and 91C of two cylinders which are spaced apart by two additional cylinders. The two additional cylinders on each cam 87C includes four rocker arms 92C driven off of the cam 87C for actuating the inlet and exhaust valves of said two additional cylinders. The rocker arms 92C and cams are all conventional designs well known in the art and therefore not described in detail. The two cams 87C are driven by drive shaft 16C through helical gear sets 94C.

The engine of the present invention may operate on a homogeneous charged Otto cycle, fuel injected diesel cycle or hydrid combustion cycles as specifically described in U.S. Pat. No. 4,765,293.

Having described the invention with sufficient clarity to enable those familiar with the art to construct and use it, I claim:

1. A barrel type internal combustion engine including an engine block having a plurality of axial-positioned cylinders with reciprocating pistons arranged in a circular pattern:

a drive shaft concentrically positioned within the cylinder block having an offset portion extending outside the cylinder block;

a wobble spider rotatably journaled to said offset portion;

connecting rods for each cylinder connecting each piston to the wobble spider;

the improvement comprising:

a first sleeve bearing means supporting the drive shaft in the engine block in a cantilevered manner for radial loads;

a second sleeve bearing means rotatably supporting the wobble spider on the offset portion of the drive shaft for radial loads;

a first roller bearing means positioned between the offset portion of the drive shaft and the wobble spider carrying thrust loadings only;

a second roller bearing means carrying thrust loads only reacting to the first roller bearing located on the opposite end of the driveshaft between the shaft and the engine block.

2. A barrel engine as set forth in claim 1, wherein the first and second said roller bearing means have a radially free floating race whereby no radial loads will be sustained by either roller bearing means.

3. A barrel engine as set forth in claim 1, wherein the primary drive is coupled to the drive shaft outboard of the offset portion.

4. A barrel engine as set forth in claim 1, wherein the primary drive is connected to the offset portions by a coupling means which transfer torsional loads only.

5. A barrel engine as set forth in claim 1, wherein the cylinder block includes a front face means outwardly from which the offset portion extends which front face provides a universal attachment area for various driven means.

6. A barrel engine as set forth in claim 1, wherein the first and second sleeve bearing means includes two spaced-apart sleeve bearings.

7. A barrel engine as set forth in claim 1 wherein the second sleeve bearing means includes two spaced-apart sleeve bearings and the first roller bearing means is positioned therebetween.

8. A barrel engine as set forth in claim 1, wherein the first and second roller bearing means are spherical roller bearings with a radially free-floating race whereby no radial loads will be sustained by either roller bearing means.

9. A barrel engine as set forth in claim 1 wherein the connecting rods for each piston includes a spherical joint on at least one end of the rod and each spherical joint includes: a ball surrounded by a bearing insert having a partial spherical surface, a pair of split bearing inserts with another partial spherical surface, a spacer ring between the two bearing inserts and retaining means holding the said inserts and spacer ring in engagement with said ball whereby the clearance fit of the spherical joint is controlled by the spacer ring.

10. A barrel engine as set forth in claim 8 wherein the ball includes a circumferential lubrication groove at its midpoint and the bearing inserts include lubrication slots extending normally from said groove.

11. A barrel engine as set forth in claim 1, wherein the connecting rods for each piston include a spherical joint on at least one end of the rod and each spherical joint includes: a ball surrounded by a bearing insert having a partial spherical surface, a pair of split bearing inserts with another partial spherical surface, a spacer ring between the two bearing inserts, a washer positioned adjacent said split bearing inserts and retaining means holding the washer against the said inserts and spacer ring in engagement with said ball.

* * * * *